United States Patent [19]

Shinoda et al.

[11] 4,370,599

[45] Jan. 25, 1983

[54] SELF SHIFT TYPE GAS DISCHARGE PANEL

[75] Inventors: Tsutae Shinoda, Akashi; Kazuo Yoshikawa, Kobe; Yoshinori Miyashita, Himeji, all of Japan

[73] Assignee: Fujitsu Limited, Kawasaki, Japan

[21] Appl. No.: 213,464

[22] Filed: Dec. 5, 1980

[30] Foreign Application Priority Data

Dec. 17, 1979 [JP] Japan ..... 54-164319

[51] Int. Cl.[3] ..... H05B 37/02

[52] U.S. Cl. ..... 315/217; 315/169.4; 315/204

[58] Field of Search ..... 315/204, 217, 169.4

[56] References Cited

U.S. PATENT DOCUMENTS 4,190,788 2/1980 Yoshikawa et al. ..... 313/204

*Primary Examiner*—Harold A. Dixon

*Attorney, Agent, or Firm*—Staas & Halsey

[57] ABSTRACT

An AC memory drive type self-shift type gas discharge panel which can prevent an accidental erroneous discharge caused by distributed abnormal charges. Abnormal charges may accumulate to a significant extent at the ends of the shift channels having write discharge cells and shift discharge cells regularly arranged. A path for leaking the abnormal charges is provided in the dielectric layer covering the electrode defining the discharge cells at the end of the shift channels.

19 Claims, 15 Drawing Figures

SELF SHIFT TYPE GAS DISCHARGE PANEL

BACKGROUND OF THE INVENTION

1. Field of the Invention

This invention relates to an improved AC memory drive type self-shift type gas discharge panel, and specifically to a new type panel structure which is capable of preventing accidental erroneous discharges caused by distributed abnormal charges.

2. Description of the Prior Art

A self-shift type gas discharge panel sends the information written in the form of discharge spots from the writing end of shift channel to the other end, where a period of the discharge cell arrangement for shift is considered as one picture element, and provides stationary display by suspending the shift operation on specific discharge cell groups during such information sending. Various types of panel structures have been proposed. FIGS. 1 and 2 respectively show in plan view and in cross section along the line II–II' the electrode arrangement of the meander electrode type gas discharge panel proposed in the U.S. Pat. No. 4,190,788 by Yoshikawa et al assigned to the same assignee as the present invention. In this case, a couple of shift channels SC1 and SC2 are typically indicated. A couple of Y (row) electrode groups y1i and y2i (where i is a positive integer), which have a meander pattern and which are guided respectively to the common buses Y1, Y2, are alternately arranged on the lower substrate 1. A couple of X (column) electrode groups x1j and x2j (where j is a positive integer) are alternately arranged at the inside of the upper substrate 2 in such a manner as to face the Y electrodes and are connected respectively to the common buses X1, X2. These X and Y electrodes on respective substrates are configured to form the shift channels SC1 and SC2. Each electrode of the X electrode groups x1j and x2j is placed in such a positional relation as to extend across an adjacent pair of electrodes of the opposing Y electrode groups y1i and y2i, and the surface of each electrode is covered with the dielectric layer 3 on the respective substrates. In addition, the write electrodes W1 and W2 are provided in the respective channels adjacent to the right most electrode x11 of the X electrode group and facing the right end electrode y11 of the Y electrode group. The discharge cells ai, bi, ci and di, formed with the four groups with four phases using each electrode alternately as a common electrode while cycling through the combinations of the four electrode groups regularly and periodically, are defined in the gap 4 between said electrodes arranged face to face. The gap 4 is filled with gas for discharge. Thereby the discharge spot generated by the write discharge cell W can be shifted sequentially along the arrangement of discharge cells. A surface layer of magnesium oxide (MgO) may be formed on said dielectric layer 3 as required in order to protect said dielectric layer from sputtering at the time of discharge.

The operation for writing information into the first shift channel SC1 in said panel structure is explained hereunder. First of all, since the write pulse is applied in accordance with said information to the write electrode W1, the write discharge cell w generates the first discharge spot at the timing where the shift electrode y11 is grounded. At this time, the shift pulse is applied to the phase A discharge cells ai of the shift channel, so that the discharge spot spreads simultaneously to the first shift discharge cell a1 adjacent to the discharge cell w by means of the priming effect of said write discharge spot. The discharge spot appearing at the discharge cell a1 may be sequentially shifted to the other end of the shift channel SC1 by shifting between adjacent pairs of discharge cells a1. b1, b1. c1, c1. d1, . . . when the shift pulses are sequentially applied to the adjacent discharge cells in the respective combinations phase A. phase B, phase B. phase C, phase C. phase D, . . . . During this operation, an erase pulse is applied to the discharge cells which have completed the shifting of a discharge spot, and thereby the undesired discharge spots are erased. As a result, the content of said information is displayed on the first shift channel SC1.

As explained above, the self-shift type gas discharge panel performs writing of the discharge spot and shift operation in accordance with the input information, however, the panel having such structure has the undesirable problem that an accidental erroneous discharge occurs at the end of the shift channel as the shift operation is repeated. Such accidental discharge is not observed at all in the well known matrix type panel and is peculiar to the self-shift type panel. Such accidental discharge has interfered with the display operation by disturbing the information within the panel. This erroneous discharge operation is now briefly explained. It may appear as a group of discharge spots around a single discharge spot of display information or it may appear as a comparatively large light emitting pattern after a momentary flash.

The inventors of this invention investigated this problem peculiar to the self-shift type panel and found that an accidental discharge results from the distribution of the stored wall charges at the ends of the shift channel due to sequential shift of the discharge spot. Namely, as explained previously, the shift operation of the discharge spot is performed by making use of the priming effect between adjacent discharge cells, and this priming effect is based on the coupling of space charges and on the coupling of wall charges. Coupling of wall charges occurs between cells which transfer the discharge spot in such a manner that electrons (minus charges) are supplied and stored and between cells which receive the same spot in such a manner that ions (plus charges) are supplied and stored. For this reason, as the shift operation advances sequentially, electrons are gradually left as wall charges at the writing end of the shift channel in the form of an excess of electrons, while the other end of the shift channel has a lack of electrons, that is, positive ions. Polarization thus occurs in the shift channel. FIG. 3 indicates this distribution of charges. The horizontal axis represents the shift channel with the right end considered as the end for writing, while the vertical axis represents potential.

Therefore, when this distribution of wall charges becomes sufficiently large due to the repetition of the shift operation, the abnormal electric field resulting from such abnormal wall charges induces an avalanche phenomenon in combination with an external field such as generated by the shift voltage, etc. The above-mentioned abnormal discharge which thus occurs is not based on the input information.

This accidental erroneous discharge is particularly remarkable for the case of the so-called drive method by the wall charge transfer system where the coupling of wall charges is positively used for the shift operation, as indicated in U.S. Pat. No. 3,781,600 by Coleman et al, rather than for the case of the so-called drive method by the space charge coupling system where the coupling of space charges is positively used for the shift operation which is indicated in the U.S. Pat. No. 4,132,924 by Yamagushi et al. The causes of said accidental erroneous discharge will be explained in more detail by referring to the drive voltage waveforms in the Coleman et al drive method. Namely, FIG. 4 shows the write electrode terminal w1 and the drive voltage waveforms to be applied to the shift buses Y1, Y2, X1, and X2, and as well the write and shift period SP and the display period DP.

As is apparent from the drive voltage waveforms of FIG. 4, since a positive write voltage Vw is applied to the write electrode w1 and the write discharge occurs during the data writing period $T_O$, the minus wall charges are formed on the dielectric layer 3 of the relevant write electrode and the plus wall charges are formed on the dielectric layer 3 of the facing shift electrode y11. In the succeeding shift operation, the plus wall charges are transferred by the voltage of the succeeding shift electrodes sequentially being dropped to the ground potential from the shift voltage $V_{sh}$. As a result, the minus charges are left at the surface of the cells after the shift operation. As these write operations and shift operations are repeated, the residual charges are not accumulated so much in the intermediate shift discharge cells since most of the charges are neutralized and erased by every polarity inversion, but the cells corresponding to the write electrodes are negatively charged by accumulation of residual minus charges and the shift termination cells are positively charged due to the accumulation of the plus charges that have been transferred.

Such abnormal discharge can be prevented by providing a discharge function for the normally stored charge at the electrodes of both ends of the shift channel. For example, the gas discharge panel disclosed in the U.S. Pat. No. 3,781,600 employs the structure for disabling storage of charges by directly exposing the electrodes at both ends of each shift channel to the gas discharge space. However, if these exposed electrodes are used, the electrode material sputters by the ion impact during discharge or the electrode is oxidized in the baking process for the sealing material on the occasion of sealing the discharge gas space. At any rate, such method has a disadvantage that the operating life is not so long due to a change of discharge characteristic at the area near the relevant electrodes. In addition, this method also has a problem that the upper limit of the write voltage margin is lowered. Namely, when the write voltage is applied to the exposed write electrodes, a heavy current flows therein for a comparatively long period, and this discharge causes unwanted discharges on the adjacent shift discharge cells. Therefore, the upper limit of said write voltage must be kept as low as possible.

SUMMARY OF THE INVENTION

This invention offers a new type of self-shift type gas discharge panel which has solved the problems of the aforementioned conventional drive method and panel structure. In more detail, it is an object of this invention to offer the most practical panel structure for avoiding accumulation of abnormal charges at the ends of shift channels.

Briefly speaking, this invention is characterized in that a path is provided in the dielectric layer covering the electrodes forming discharge cells at the ends of a shift channel in order to leak and exhaust abnormal charges accumulated on said dielectric layer.

Other objects and features of this invention will be understood from the explanation for the preferred embodiments with respect to the following drawings.

DESCRIPTION OF THE PREFERRED EMBODIMENTS

Figure 1:
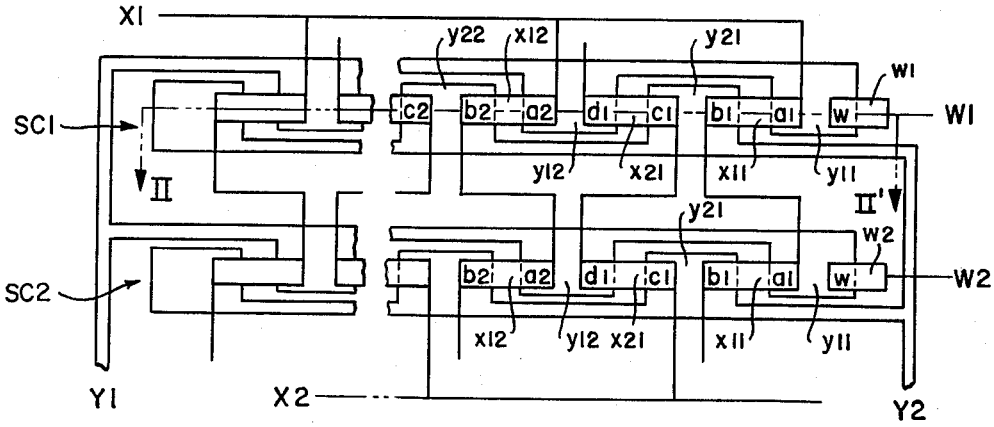
FIG. 1. (PRIOR ART)
FIGS. 1 and 2 respectively show a plan view and a cross section along the line II–II' of the electrode arrangement of the meander electrode type self shift type gas discharge panel as discussed above.
Figure 2:
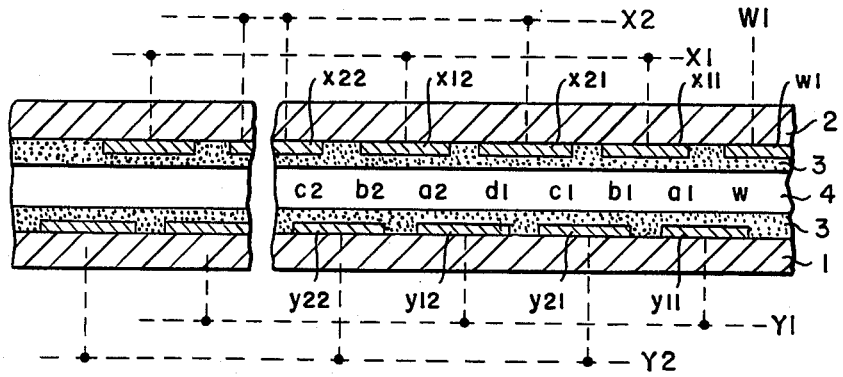
FIG. 2. (PRIOR ART)
Figure 5:
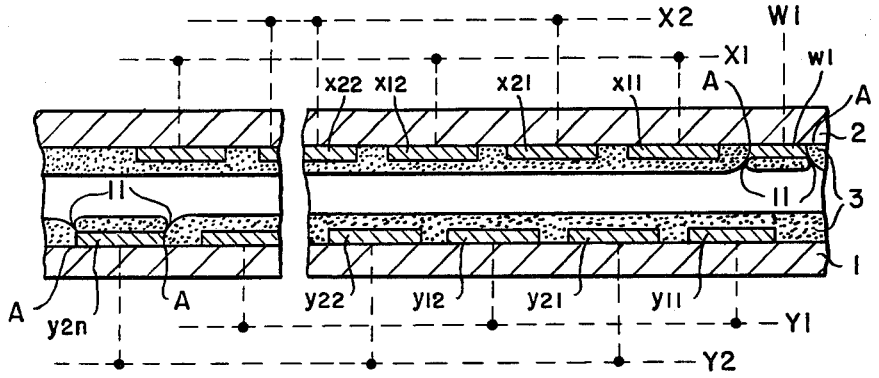
FIG. 5 is the cross section indicating an embodiment of the self shift type gas discharge panel of the present invention.

FIG. 5 shows a cross section of a self-shift type gas discharge panel according to one embodiment of the present invention. In this case, the electrode arrangement shown is the 2×2 phase meander electrode arrangement shown in FIG. 2. However, as a characteristic of this invention, the difference from the panel of FIG. 2 is the structure of the dielectric layer. Namely, in FIG. 5, a crevice or crack 11 that extends from the surface of said dielectric layer 3 to the electrode edges A is respectively formed on the write electrode w1 and the final shift electrode $y_{2n}$, thus in the outermost discharge cells at the ends of each shift channel. When such a crevice 11 is provided, unwanted extra wall charges from the shift discharge on said relevant dielectric layer 3 leak to said write electrode w1 and to the final shift electrode y2n through the crevice 11 at the left of FIG. 5. Alternately, the present invention may be applied to only one of the outermost electrodes of each shift channel, namely, either to the write electrode w or the final electrode of the shift channel $y_{2n}$. In short, abnormal charges which may cause erroneous discharge are thus not accumulated.

Figure 6A:
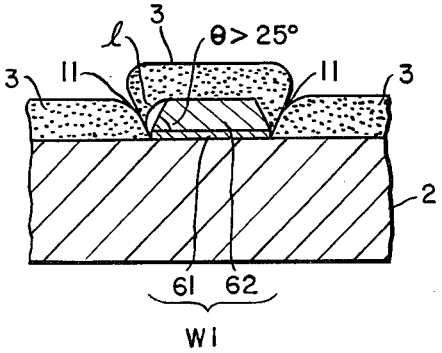
FIGS. 6A to 8B are cross sections of electrodes for respectively realizing the dielectric layer structure in the panel indicated in FIG. 5.

Four kinds of methods to form the crevice 11 on the dielectric layer over the corresponding electrodes will be explained hereunder focusing on the case where the crevice is applied to the write electrode W. Namely, FIGS. 6A and B respectively show in cross section the enlarged write electrode W1 and the adjacent shift electrode x11 in order to explain the first method. FIG. 6A shows the glass substrate 2, a double layered write electrode W1 of chromium (Cr) 61 and copper (Cu) 62 evaporated on the glass substrate 2 and a dielectric layer 3 formed by evaporation of alumina ($Al_2O_3$). Here, if an inclination angle O of the rising edge of said electrode W1 is 25° or more from the surface of the glass substrate 2, a crevice 11 is generated toward the upper surface of the dielectric layer 3 from the electrode edge A when the dielectric layer is evaporated, but if such inclination angle O is 25° or less, no such crevice is generated. The reason may be explained as follows. As the inclination angle O becomes large, the dielectric material to be deposited on the electrode edge A is influenced by the shielding effect of the periphery and deposition of the dielectric layer 3 at the electrode edge A is no longer continuous. Thereby, a crevice 11 is generated.

For this reason, the panel structure of this invention can be formed as follows. The inclination angle of the periphery of the write electrode and the final shift electrode from the glass substrate is set to 25° or more, the inclination of the periphery of the remaining shift electrodes is set to 25° or less, and the dielectric layer is formed thereon by evaporation.

Then, a method for forming the electrode structure where the inclination angle is set as desired will be explained. First of all, the Cr layer 61 which assures bonding with the glass substrate is formed by evaporation on said glass substrate 2 in a thickness of at least about 500 A °, and thereafter the Cu layer 62 is formed also by evaporation to a thickness of 1 micron on said evaporated Cr layer 61. Subsequently, a photo resist film is coated on the entire part, and the photo resist film at the area near the expected write electrode forming region is patterned as desired. Then, etching is performed for Cu using an etching solution of sulfuric acid ($H_2SO_4$), hydrogen peroxide ($H_2O_2$) and water ($H_2O$). In this case, when the $H_2O_2$ content in the etching solution increases, said inclination angle becomes large. Therefore, etching should be performed by adjusting the $H_2O_2$ content to the value which assures said inclination angle to 25° or more. The evaporated Cu layer 62 for forming the write electrodes is thus formed with the specified inclination angle of 25° or more. FIG. 6A shows the cross section of such a write electrode W1.

When said photoresist film is removed, another photoresist film is formed again on the entire part, and the photoresist film on the shift electrode forming region other than the write electrode forming region is patterned.

Figure 6B:
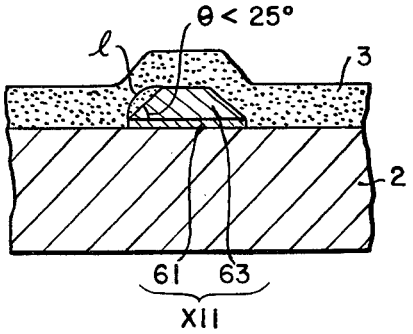

Thereafter, etching is performed using said etching solution for Cu after adjusting the $H_2O_2$ content so that said inclination angle becomes 25° or less. The evaporated Cu layer 63 which forms the shift electrode other than the write electrode is formed in the specified inclination angle of 25° or less. FIG. 6B is the cross section of such a shift electrode x11.

Subsequently, the photoresist film is removed and the etching is performed for the foundation chromium layer using an etching solution of ferric chloride ($FeCl_3$), caustic soda (NaOH) and water ($H_2O$) with the evaporated Cu layer formed at the specified inclination angle used as the mask. This etching forms the write electrodes and the shift electrodes other having the respective specified inclination angles. When the dielectric layer 3 of $Al_2O_3$ is evaporated on the electrode surface on the substrate which will become the display region, one electrode substrate of the panel is completed. At the time of forming such electrode substrate, said crevice 11 is generated in the dielectric layer at a position corresponding to the write electrode W.

Since the evaporated Cr layer 61 is very thin, the inclination angle O of said electrode is considered substantially equal to the angle formed by the evaporated Cu layer. The other electrode substrate can be configured in the same way as the above manufacturing process. The electrodes are formed also on the other glass substrate 1 where the inclination angle of only the final shift electrode y2n is set to 25° or more while that of the remaining shift electrodes is set to 25° or less, and the dielectric layer is formed by the thin film technique on such electrodes. Thus, when said one electrode substrate 2 and said other electrode substrate 1 are arranged face to face across the gas space, the self shift type gas discharge panel of this invention can be completed.

Figure 7A:
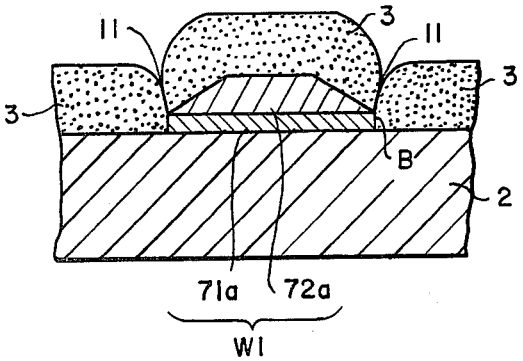

FIGS. 7A and B respectively show in enlarged cross section the write electrode W1 and the adjacent shift electrode x11 in order to explain the second method of forming the crevice.

As indicated in FIG. 7A, according to this method, a thick foundation Cr layer 71 is formed with a thickness of 2000 A° at the expected write electrode forming region on the glass substrate 2, and then the evaporated Cu layer 72 *a* is formed thereon with thickness of 1 micron. In addition, as shown in FIG. 7B, a thin foundation Cr layer 71 is formed with thickness of 500 A° at the expected shift electrode forming region other than the expected write electrode forming region on the glass substrate 2, and then the evaporated Cu layer 72*b* is formed thereon with the thickness of 1 micron.

Thereafter, after coating the photoresist film on the entire part of said glass substrate 2, said photoresist film is subjected to the patterning into the specified pattern and the evaporated Cu layer is etched by the etching solution for Cu in such a manner that it has the edges in the specified inclination angle of 25° or less. Then, the foundation Cr layer is etched into the specified pattern using the etching solution for Cr with the said etched evaporated Cu layer used as the mask.

Thus, a write electrode W1 has an electrode structure as indicated in FIG. 7A, with a thick foundation evaporated Cr layer 71*a* having a highly inclined edge is formed on the glass substrate 2 and the evaporated Cu layer 72*a* having the lesser inclined edge is formed on said Cr layer 71*a*. When the dielectric layer 3 is evaporated on the electrode and glass substrate 2 thus formed, the dielectric layer becomes discontinuous at the edge B where the evaporated Cr layer 71*a* and the evaporated Cu layer 72*a* meet, and the crevice 11 extends upward in the dielectric layer 3 from that point.

Figure 7B:
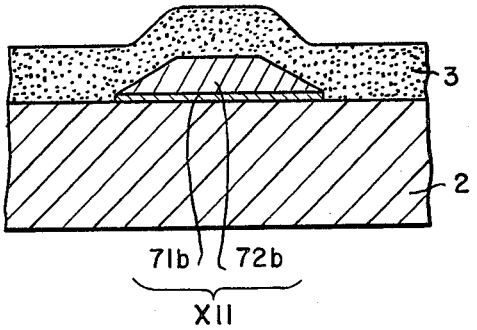

On the other hand, as indicated in FIG. 7B, the shift electrode x11 is provided in such a manner that the evaporated Cu layer 72*b* having the edge inclination angle of 25° or less is formed on the thin Cr layer 71*b* formed on the substrate 2, and therefore no crevice is generated on the dielectric layer corresponding to the relevant electrode as indicated in FIG. 6B.

In the same manner, the final shift electrode y2n of the other glass substrate 1 is formed in the same shape as the write electrode W1 and the other shift electrodes are formed in the same shape as the aforementioned X side shift electrode x11. Thus, the crevice 11 is generated in the dielectric layer 3 corresponding to the final shift electrode y2n by forming the dielectric layer on the substrate 1 involving these shift electrodes.

Figure 4:
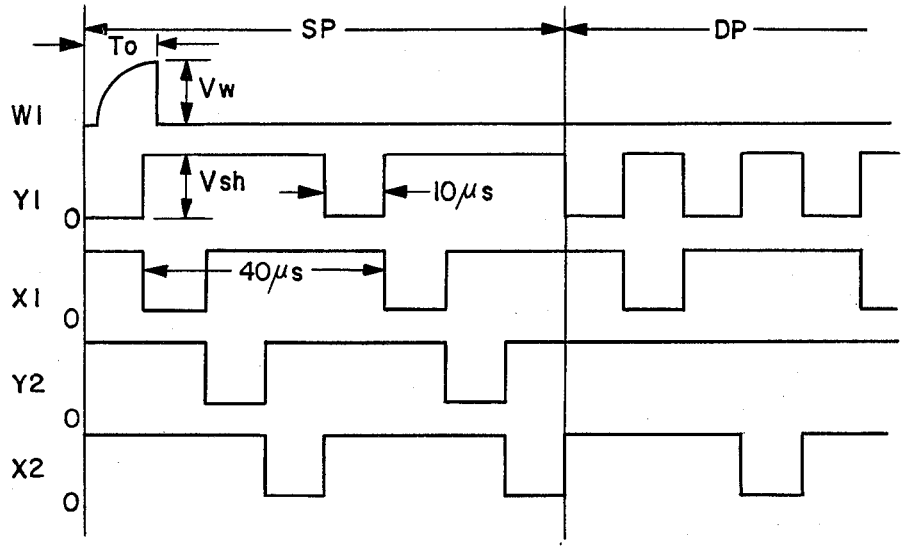

By arranging face to face both glass substrates 1 and 2 thus formed, the gas discharge panel having the dielectric layer structure as indicated in FIG. 4 can be formed.

Figure 8A:
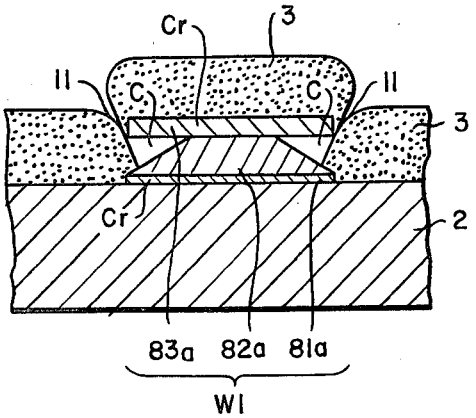

FIGS. 8A and B respectively shown in enlarged cross section the write electrode W and the shift electrode x11 adjacent thereto to indicate a third method for forming the crevice. According to the third method, a thin foundation evaporated Cr layer 81*a* is formed with thickness of 500 A° on the expected write electrode forming region on the glass substrate 2 as indicated in FIG. 8A, the evaporated Cu layer 82*a* is formed thereon in the thickness of 1 micron, and moreover the thick evaporated Cr layer 83*a* is formed thereon with thickness of 2000 A° thus forming the electrode conductor of the three layers.

Figure 8B:
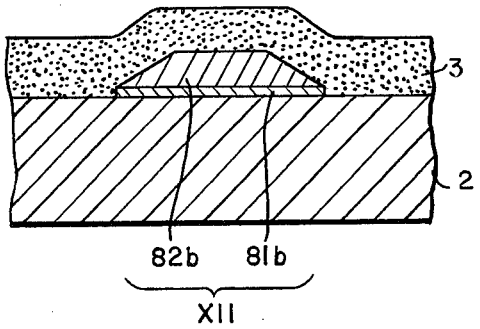

As indicated in FIG. 8B, the foundation Cr layer 81*b* is formed with thickness of about 500 A° on the expected shift electrode forming region other than the expected write electrode forming region on the glass substrate 2, and the evaporated Cu layer 82*b* is formed thereon with thickness of 1 micron, thus forming the electrode conductor of the double layer.

Thereafter, the photoresist film is formed and the top layer of Cr is etched by the etching solution for Cr. In this case, etching is not performed for the evaporated Cu layer 82*b* on the expected shift electrode forming region.

Then, when the etching is performed using the etching solution for Cu which assures an inclination angle of 25° or less, the uppermost evaporated Cr layer 83*a* of the expected write electrode forming region is not etched, and only the lower evaporated Cu layer 82*a* is etched since the abovementioned evaporated Cr layer 83*a* works as the mask, thereby the Cr layer 83*a* developed an overhang. In addition, the evaporated Cu layer 82*b* of the expected shift electrode forming region is etched, thus forming a structure having the edge inclination angle of 25° or less.

Then, the foundation Cr layers 81*a*, 81*b* are etched by the etching solution for Cr and write and shift electrodes are formed in the predetermined patterns.

Thereby, as indicated in FIG. 8A, the write electrode W of the three layer structure has the foundation Cr layer 81*a*, the evaporated Cu layer 82*a* having the inclined edge, and the evaporated Cr layer 83*a* projected from the evaporated Cu layer 82*a*. When the dielectric layer 3 is formed by evaporation on the electrode and glass substrate 2, the crevice 11 is formed toward the upper side of the dielectric layer 3 from the gap C formed between said projected evaporated Cr layer 23*a* and the evaporated Cu layer 82*a* having the inclined edge.

In the same manner, the final shift electrode of the other glass substrate 1 provides the same structure as the write electrode and a crevice can also be generated in the dielectric layer of the relevant electrode. Thus, the gas discharge panel having the same dielectric layer structure as that indicated in FIG. 4 can be formed by arranging both substrates face to face.

The abovementioned 1st to 3rd crevice forming methods use the difference in edge coverage of the dielectric layer for the electrode, but the 4th method utilizes very simple mechanical method. In other words, in the 4th method, a damaged area or crack which extends up to the relevant electrode surface is produced by the blade of a knife etc. in the dielectric layer corresponding to the write electrode or the final shift electrode on which the crevice should be formed on the electrode substrate where the electrode and dielectric layer are already formed, and thereby abnormal charges are allowed to be leaked through such damage or crack.

An embodiment of this invention has been explained above, but the subject matter of this invention is not limited thereto but allows a variety of modifications and variations as follows.

Figure 9:
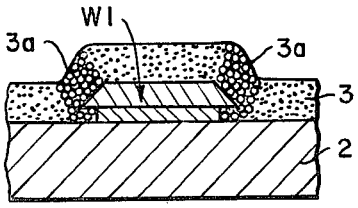
FIGS. 9 to 12 are cross sections indicating variations of the self-shift type gas discharge panel of the present present invention.

(1) As indicated in FIG. 9, a part or the entire part of the dielectric layer 3 corresponding to the write electrode W and/or the final shift electrode y2n is formed as a porous layer 3*a* and abnormal charges can be leaked through many pores of this porous layer. The porous layer 3*c* can be formed as follows. The dielectric layer itself formed at the edge of the relevant electrode in the subsequent evaporation of the dielectric layer can be filled in the relevant area with the mixture of alumina powder and solder glass, namely with a porous material, or by forming the electrode in the double layer of Cr-Cu as indicated in FIG. 9 in such a way as incorporating air bubbles at the edges.

Figure 10:
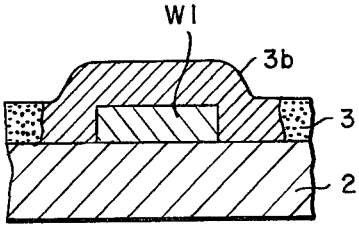

(2) As indicated in FIG. 10, the entire part or a part of the dielectric layer 3 corresponding to the write electrode W and/or the final shift electrode y2n is formed by the material 3*b* having a high resistance value, and thereby it is possible to leak abnormal charges and prevent accumulation of such charges by means of such a high resistance material layer. As a high resistance material, tantalum nitride (TaN), indium oxide ($InO_2$), tin oxide ($SnO_2$) etc. can be used.

Figure 11:
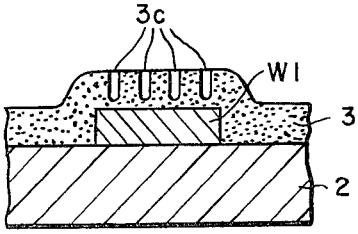

(3) As indicated in FIG. 11, a plurality of holes 3*c* may be provided on the dielectric layer 3 using a laser beam and abnormal charges can be leaked therethrough.

Figure 12:
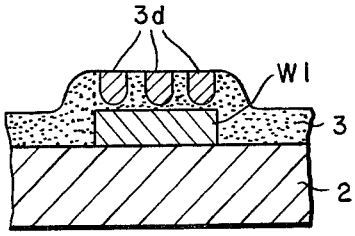

(4) As indicated in FIG. 12, a conductive material 3*d* may be injected into the dielectric material by means of the well known ion injection method, and abnormal charges can also be leaked through such injected conductive material.

Other applications of the present invention are possible. Besides the aforementioned meander electrode type self shift gas discharge panel, the present invention can also be applied to the panel having the meander type shift channel disclosed in the specification of the U.S. Ser. No. 810,747. Moreover, this invention can be applied to a panel having the electrode structure where the number of electrode groups is increased to 2 groups×2 groups or more, a panel providing a parallel electrode structure, and a panel having a monolithic structure or a matrix electrode structure as disclosed in U.S. Pat. No. 3,944,875.

Figure 3:
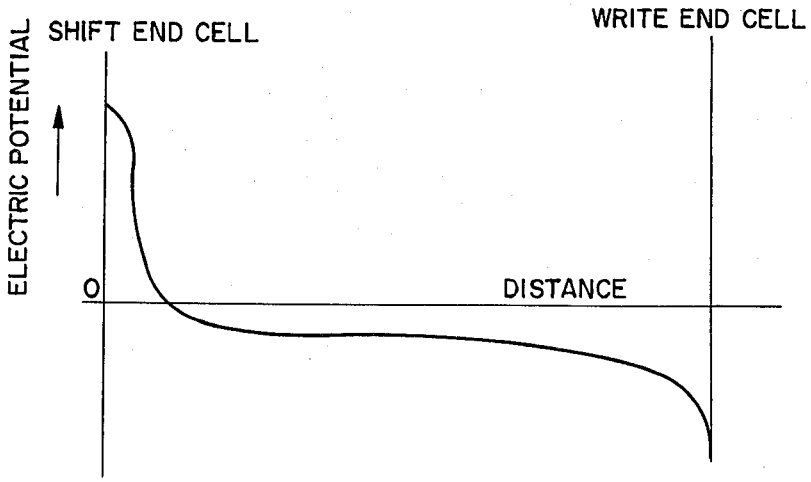
FIGS. 3 and 4 respectively show the charge distribution and drive voltage waveforms for explaining generation of accidental erroneous discharges in the panel of FIG. 1 and FIG. 2.

As explained for the above embodiments, it is best to provide a path for leaking abnormal charges on the dielectric layer corresponding to the write electrode and the final shift electrode which determine the discharge cells at both ends of the shift channel, but in the case of the panel which employs the aforementioned space charge coupling type drive system, since less amount of abnormal charges are accumulated, particularly the amount of accumulation in the write electrode is less than that in the final shift electrode as is clear in FIG. 3, so that the probability of generating an erroneous discharge is also lower, a sufficient effect can be obtained by providing the leak path only to the final shift electrode. However, in case the above-mentioned wall charge coupling type drive system is employed, since abnormal charges are rapidly accumulated in a short period of time, it is desirable to provide the leak path in the crevice structure on the dielectric layer at both ends of the shift channel. Such leak path can be provided to any specified area including the cells at the end of the shift channel or at the whole area of the dielectric layer corresponding to the shift channel.

As will be understood from the above description, this invention provides, in short, a wall charge leak path in order to prevent accumulation of abnormal wall charges at least on the dielectric layer corresponding to the outermost electrode of the discharge cell at the end of the shift channel in the AC memory drive type self shift gas discharge panel, and thereby prevents accidental erroneous discharges caused by distribution of abnormal charges which are peculiar to the self shift panel. Moreover, said outermost electrode is protected by the dielectric layer and therefore it is not sputtered during discharge and is not oxidized even during the sealing of the gas space. Therefore, the panel of this invention assures stable characteristics and long operating life. The present invention is thus very effective for improving the performance of the self shift type gas discharge panel.

We claim:

1. A self shift type gas discharge panel comprising a regularly arranged plurality of discharge cells defining an array of shift channels wherein electrodes defining the discharge cells are sequentially and regularly connected to a plurality of buses, covered with a dielectric layer and placed face to face in a gas discharge space, a write discharge cell with a write electrode at one end of each said shift channel, and path means provided in said dielectric layer for leaking wall charges accumulated on said dielectric layer to at least one outermost electrode along each said shift channel.

2. The panel of claim 1, wherein the path means comprises a path formed as a crevice which starts from the surface of said dielectric layer and extends to the surface of said at least one outermost electrode.

3. The panel of claim 2, wherein the edge surface of said at least one outermost electrode has an inclination angle of at least 25° and the crevice is produced by insufficient edge coverage of the dielectric layer which is formed by evaporation.

4. The panel of claim 2, wherein at least each said at least one outermost electrode comprises a double layer structure with an upper layer comprising copper, on a foundation layer comprising chromium.

5. The panel of claim 4, said upper layer of copper on each said at least one outermost electrode having a configuration with at least one surface with an angle of inclination of at least 25° from said substrate.

6. The panel of claim 5, the electrodes other than said at least one outermost electrode also comprising said double layer structure, the upper layer of copper thereof having a configuration with a maximum angle of inclination of 25° from said substrate.

7. The panel of claim 4, all of said electrodes of said shift channels having said double layer, and said upper copper layer of all said electrodes having a configuration with a maximum angle of inclination of 25°, said lower layer of chromium of said at least one outermost electrode being thicker than in the outer electrodes.

8. The panel of claim 4, each said foundation layer of chromium having a thickness of approximately 2000 angstroms and each said upper layer of copper having a configuration with a maximum angle of inclination of 25°.

9. The panel of claim 1, wherein the path means comprises a path formed with a porous insulating material.

10. The panel of claim 1, wherein the path means comprises a path formed with a high resistance material.

11. The panel of claim 10, said high resistance material being tantalum nitride, indium oxide, or tin oxide.

12. The panel of claim 1, wherein the path means comprises a path formed as plural holes into the dielectric layer over said at least one outermost electrode.

13. The panel of claim 1, wherein the path means comprises a path formed by conductive impurity ions injected into the dielectric layer.

14. The panel of claim 4, 12 or 13 comprising a third layer of chromium formed on the dual layer of each said at least one outermost electrode of each said shift channel to overhang the upper layer of copper.

15. The panel of claim 1, 2, 9, 10, 11 or 13, wherein the at least one outermost electrode of each said shift channel is the respective write electrode.

16. The panel of claim 1, 2, 9, 10, 12 or 13 wherein the at least one outermost electrode of each said shift channel is the respective final shift electrode along the shift channel.

17. The panel of claim 16 comprising means for operating said shifting of discharge spots along said shift channels by utilizing coupling of space charges.

18. The panel of claim 1, 2, 9, 10, 12 or 13 comprising means for operating said shifting of discharge spots along said shift channels by utilizing coupling of wall charges, and providing said path means at said outermost electrodes at both ends of each said shift channel.

19. The panel of claim 1, 2, 9, 10, 12 or 13, wherein the path means are provided at the whole parts of the dielectric layer corresponding to the shift channel.

* * * * *

UNITED STATES PATENT AND TRADEMARK OFFICE

CERTIFICATE OF CORRECTION

PATENT NO. : 4,370,599

DATED : 25 January 1983

INVENTOR(S) : TSUTAE SHINODA et al

It is certified that error appears in the above-identified patent and that said Letters Patent is hereby corrected as shown below:

Col. 10, line 6, "outer" should be --other--.

Signed and Sealed this

*Fifth* Day of *July 1983*

[SEAL]

*Attest:*

GERALD J. MOSSINGHOFF

*Attesting Officer*

*Commissioner of Patents and Trademarks*